US006788203B1

(12) United States Patent
Roxbury et al.

(10) Patent No.: US 6,788,203 B1
(45) Date of Patent: Sep. 7, 2004

(54) MAILBOX AND COUNTER COMBINATION DEVICE

(76) Inventors: Brian A. Roxbury, 96 N. 168th Ave., Holland, MI (US) 49424; Cerrie Roxbury, 96 N. 168th Ave., Holland, MI (US) 49424

( * ) Notice: Subject to any disclaimer, the term of this patent is extended or adjusted under 35 U.S.C. 154(b) by 0 days.

(21) Appl. No.: 10/618,943

(22) Filed: Jul. 15, 2003

(51) Int. Cl.[7] ..... G08B 13/08

(52) U.S. Cl. ..... 340/545.6; 340/545.1; 340/539.1; 232/35; 232/37

(58) Field of Search ..... 340/545.1, 545.6, 340/539.1; 232/17, 19, 35, 37

(56) References Cited

U.S. PATENT DOCUMENTS

D315,821 S 8/1888 Lorenzi
4,340,809 A 7/1982 Betcher
4,868,543 A * 9/1989 Binkley ..... 340/569
4,872,210 A 10/1989 Benages
5,377,906 A 1/1995 Mason
5,664,728 A 9/1997 Jones
5,917,411 A 6/1999 Baggarly
5,954,264 A 9/1999 Keller
2004/0060975 A1 * 4/2004 Dalgaard et al. ..... 232/35

* cited by examiner

*Primary Examiner*—Julie Lieu

(57) ABSTRACT

A mailbox and counter combination device for determining a number of times a mailbox has been opened includes a mailbox having an opening extending therein. A door is hingedly coupled to the mailbox such that the door may be selectively positioned in an open position or a closed position with respect to the opening. A sensor is adapted for detecting when the door is moved from the closed position to the open position. A processor is operationally coupled to the sensor and is adapted for recording a number of times the door is moved to the open position.

10 Claims, 3 Drawing Sheets

MAILBOX AND COUNTER COMBINATION DEVICE

BACKGROUND OF THE INVENTION

1. Field of the Invention

The present invention relates to mailbox and security combination devices and more particularly pertains to a new mailbox and security combination device that allows the owner of a mailbox to keep track of the number times a mail box has been opened to determine if the mailbox has been opened more than needed in order to deposit mail therein.

2. Description of the Prior Art

The use of mailbox and security combination devices is known in the prior art. While these devices fulfill their respective, particular objectives and requirements, the need remains for a device that tracks the number of times a mailbox has been opened to ensure that neither the mailbox, nor the mail therein, has been tampered with.

SUMMARY OF THE INVENTION

The present invention meets the needs presented above by including a sensor for determining when the mailbox has been opened and a processor for tracking the number of times the sensor detects that the door may be opened.

Another object of the present invention is to provide a new mailbox and security combination device that includes a remote display for displaying on a remote housing the number of times that the processor has tracked the door of the mailbox being opened. The remote display may be used from within, for example, a vehicle or dwelling occupied by the owner of the mailbox so that the owner knows when the mailbox has been opened.

To this end, the present invention generally comprises a mailbox having an opening extending therein. A door is hingedly coupled to the mailbox such that the door may be selectively positioned in an open position or a closed position with respect to the opening. A sensor is adapted for detecting when the door is moved from the closed position to the open position. A processor is operationally coupled to the sensor and is adapted for recording a number of times the door is moved to the open position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
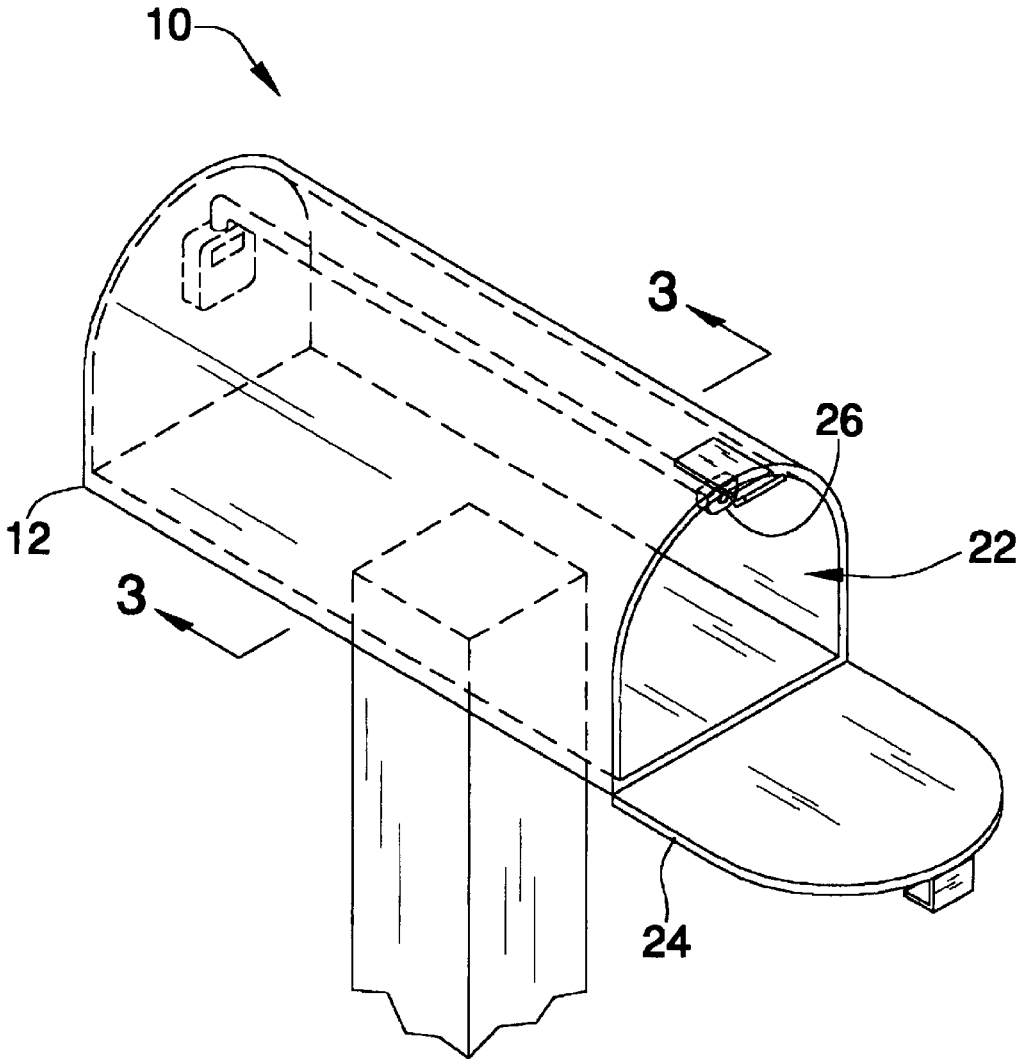
FIG. 1 is a schematic perspective view of a mailbox and counter combination device according to the present invention.
Figure 2:
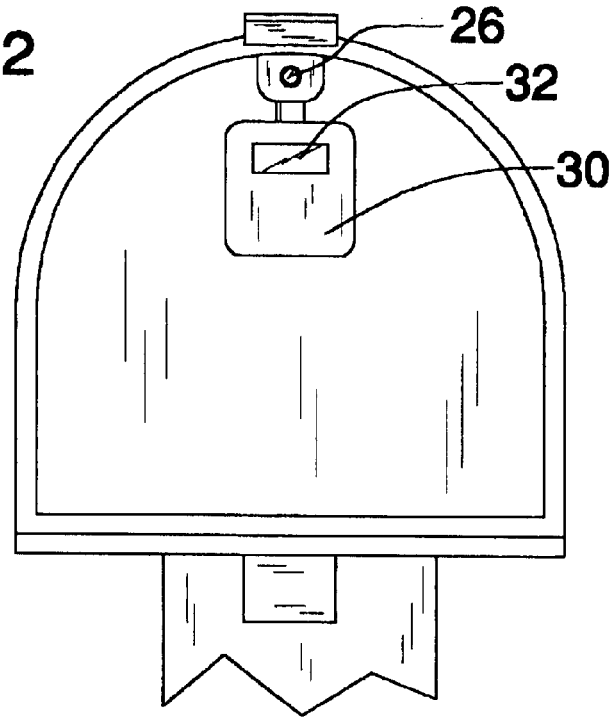
FIG. 2 is a schematic front view of the present invention.
Figure 3:
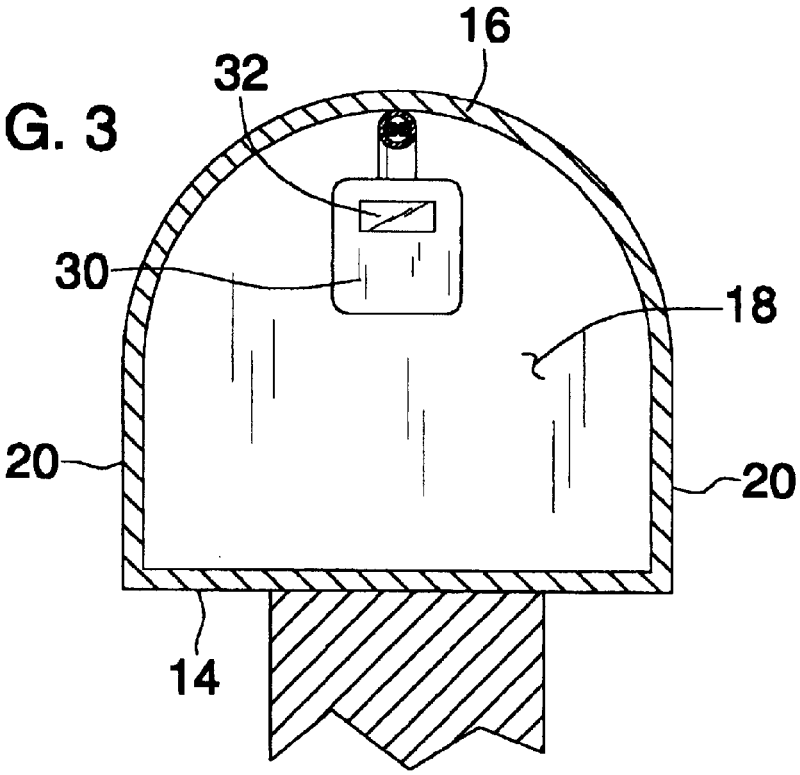
FIG. 3 is a schematic cross-sectional view taken along line 3—3 of FIG. 1 of the present invention.
Figure 4:
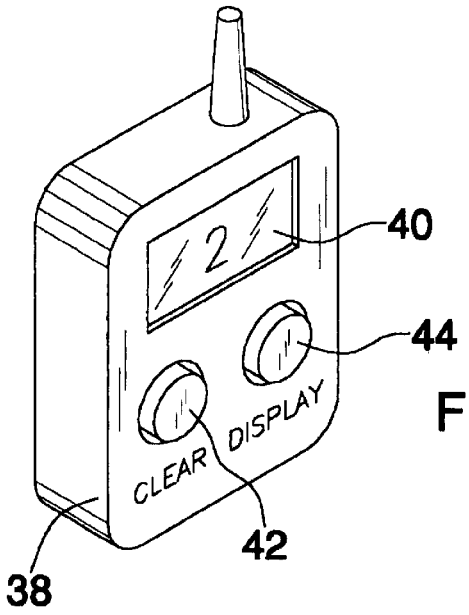
FIG. 4 is a schematic perspective view of the remote display and remote housing of the present invention.
Figure 5:
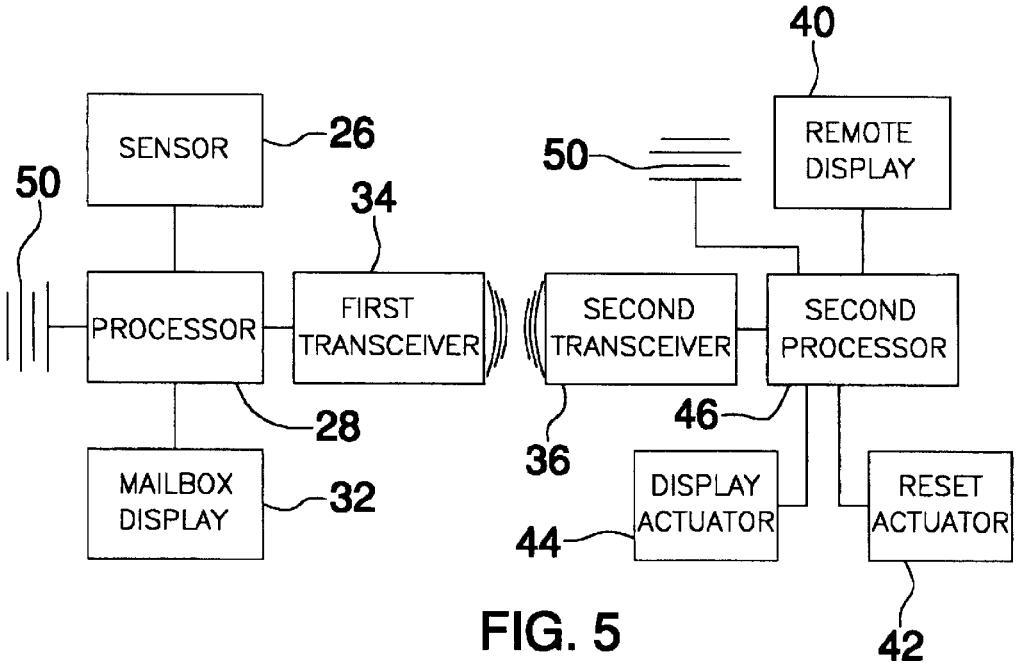
FIG. 5 is an electronic schematic view of the present invention.

With reference now to the drawings, and in particular to FIGS. 1 through 5 thereof, a new mailbox and security combination device embodying the principles and concepts of the present invention and generally designated by the reference numeral 10 will be described.

As best illustrated in FIGS. 1 through 5, the mailbox and counter combination device 10 generally includes a mailbox 12 having a bottom wall 14, an upper wall 16, a back wall 18 and a pair of side walls 20. A front of the mailbox defines an opening 22 into the mailbox 12. A door 24 is hingedly coupled to the mailbox 12 for selectively positioning in an open position or a closed position with respect to the opening 22.

A sensor 26 is mounted in the mailbox 12 and is adapted for detecting when the door 24 is moved from the closed position to the open position. The sensor 26 preferably comprises a motion detector that is positioned generally adjacent to the opening 22. The motion detector, or sensor 26, is preferably mounted on an inner surface of the upper wall 16 to prevent impacts on the sensor when mail is deposited and withdrawn from the mailbox 12. The motion detector 26 is conventional and is adapted for detecting movement of the door 24 away from the opening 22.

A processor 28 is operationally coupled to the sensor 26 and is adapted for recording a number of times the door 24 is moved to the open position. The processor 28 preferably adds a time delay to the sensor 26 so that the sensor 26 may detect movement only once per every 5 seconds to 30 seconds. The processor 28 is positioned within a processor housing 30 that is mounted within the mailbox 12 and preferably positioned on an inner surface of the back wall 18. A mailbox display 32 is operationally coupled to the processor 28 for displaying the number of times the door 24 is moved to the open position. The mailbox display 32 is ideally a LCD display positioned on the processor housing 30 and directed toward the opening 22 in the mailbox 12. A first transceiver 34 is operationally coupled to the processor 26 for wireless transmittal of the number of times the door 24 is moved to the open position.

A second transceiver 36 is adapted for receiving the wireless transmittal from the first transceiver 34. The second transceiver 36 is preferably mounted in a remote housing 38. A remote display 40 is operationally coupled to the second transceiver 36 for displaying the number of times the door 24 is moved to the open position. The remote display 40 is preferably a LCD display mounted on the remote housing 38. A reset actuator 42, mounted on the remote housing 38, is operationally coupled to the second transceiver 36 for selectively sending a wireless signal to the first transceiver 34 to instruct the processor 28 to reset to zero the number of times the door 24 is moved to the open position. A display actuator 44, mounted on the remote housing 38, is operationally coupled to the remote display 40 for selectively turning the remote display 40 on or off. Within the remote housing 38 may be positioned a second processor 46 which is operationally coupled to the second transceiver 36, the remote display 40 and the actuators 42, 44. Conventional power supplies, such as batteries 50, may be electrically coupled to the first 34 and second 36 transceivers for powering such.

In use, the device 10 is used for monitoring when a mailbox has been opened, and how many times the mailbox has been opened. The remote housing 38 would generally be kept within a vehicle or dwelling of the person who owns the mailbox 12 so that the owner may selectively activate the remote display 40 to see if the mailbox has been opened. If the mailbox 12 has been opened, this would generally indicate that the mailbox has mail therein. The mailbox display 32 may be used generally as a security device to determine if the mailbox 12 has been opened more times than would be required to deposit mail therein.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A mailbox and counter combination device, comprising:

a mailbox having an opening extending therein, a door being hingedly coupled to said mailbox for selectively positioning in an open position or a closed position with respect to said opening;

a sensor adapted for detecting when said door is moved from said closed position to said open position; and a processor being operationally coupled to said sensor and being adapted for recording a number of times said door is moved to said open position.

2. The mailbox and counter combination device of claim 1, wherein said sensor comprises a motion detector mounted in said mailbox and positioned generally adjacent to said opening, said motion detector being adapted for detecting movement of said door away from said opening.

3. The mailbox and counter combination device of claim 1, further including a mailbox display being operationally coupled to said processor for displaying the number of times said door is moved to said open position.

4. The mailbox and counter combination device of claim 3, further including a first transceiver being operationally coupled to said processor for wireless transmittal of said number of times said door is moved to said open position, a second transceiver being adapted for receiving said wireless transmittal from said first transceiver, a display being operationally coupled to said second transceiver for displaying said number of times said door is moved to said open position.

5. The mailbox and counter combination device of claim 1, further including a first transceiver being operationally coupled to said processor for wireless transmittal of said number of times said door is moved to said open position, a second transceiver being adapted for receiving said wireless transmittal from said first transceiver, a display being operationally coupled to said second transceiver for displaying said number of times said door is moved to said open position.

6. The mailbox and counter combination device of claim 5, further including a reset actuator being operationally coupled to said second transceiver for selectively sending a wireless signal to said first transceiver to instruct said processor to reset to zero said number of times said door is moved to said open position.

7. The mailbox and counter combination device of claim 6, further including a display actuator being operationally coupled to said remote display for selectively turning said remote display on or off.

8. The mailbox and counter combination device of claim 4, further including a reset actuator being operationally coupled to said second transceiver for selectively sending a wireless signal to said first transceiver to instruct said processor to reset to zero said number of times said door is moved to said open position.

9. The mailbox and counter combination device of claim 8, further including a display actuator being operationally coupled to said remote display for selectively turning said remote display on or off.

10. A mailbox and counter combination device, comprising:

a mailbox having a bottom wall, an upper wall, a back wall and a pair of side walls, a front of said mailbox defining an opening into said mailbox, a door being hingedly coupled to said mailbox for selectively positioning in an open position or a closed position with respect to said opening;

a sensor adapted for detecting when said door is moved from said closed position to said open position, said sensor comprising a motion detector mounted in said mailbox and positioned generally adjacent to said opening, said motion detector being adapted for detecting movement of said door away from said opening;

a processor being operationally coupled to said sensor and being adapted for recording a number of times said door is moved to said open position;

a mailbox display being operationally coupled to said processor for displaying the number of times said door is moved to said open position;

a first transceiver being operationally coupled to said processor for wireless transmittal of said number of times said door is moved to said open position;

a second transceiver being adapted for receiving said wireless transmittal from said first transceiver;

a remote display being operationally coupled to said second transceiver for displaying said number of times said door is moved to said open position;

a reset actuator being operationally coupled to said second transceiver for selectively sending a wireless signal to said first transceiver to instruct said processor to reset to zero said number of times said door is moved to said open position; and a display actuator being operationally coupled to said remote display for selectively turning said remote display on or off.

* * * * *